US008528518B2

(12) United States Patent
Eiermann

(10) Patent No.: US 8,528,518 B2
(45) Date of Patent: Sep. 10, 2013

(54) ROTARY PISTON FOR A ROTARY PISTON ENGINE AND ROTARY PISTON ENGINE

(75) Inventor: Dankwart Eiermann, Weissensberg (DE)

(73) Assignee: Wankel Supertec GmbH, Cottbus (DE)

( * ) Notice: Subject to any disclaimer, the term of this patent is extended or adjusted under 35 U.S.C. 154(b) by 628 days.

(21) Appl. No.: 12/800,566

(22) Filed: May 18, 2010

(65) Prior Publication Data

US 2010/0300402 A1 Dec. 2, 2010

(30) Foreign Application Priority Data

May 19, 2009 (DE) ..... 10 2009 022 490

(51) Int. Cl.
*F02B 53/10* (2006.01)

(52) U.S. Cl.
USPC ..... 123/205; 418/61.2; 418/91; 418/83

(58) Field of Classification Search
USPC ..... 418/61.2, 86, 91, 72, 107, 83, 186; 123/205
See application file for complete search history.

(56) References Cited

U.S. PATENT DOCUMENTS

| | | | | |
|---|---|---|---|---|
| 3,007,460 | A | 11/1961 | Bentele et al. | |
| 3,652,190 | A * | 3/1972 | Keller et al. | 418/54 |
| 3,779,214 | A * | 12/1973 | Ward et al. | 123/220 |
| 3,836,294 | A * | 9/1974 | Steinwart et al. | 418/91 |
| 4,000,721 | A * | 1/1977 | Carside | 123/220 |
| 4,102,615 | A * | 7/1978 | Irgens | 418/86 |
| 4,159,888 | A * | 7/1979 | Thompson | 415/105 |
| 4,486,159 | A * | 12/1984 | Garside | 418/61.2 |
| 4,741,681 | A * | 5/1988 | Bernstrom | 418/61.3 |
| 4,772,189 | A * | 9/1988 | Garside | 418/61.2 |
| 4,783,083 | A * | 11/1988 | Wankel | 277/300 |
| 4,793,304 | A * | 12/1988 | Eiermann | 123/205 |
| 4,898,522 | A * | 2/1990 | Edelmayer | 418/61.2 |
| 5,049,049 | A * | 9/1991 | Eiermann | 418/61.2 |
| 6,146,120 | A * | 11/2000 | Harms | 418/61.2 |
| 6,234,775 | B1 * | 5/2001 | Agner et al. | 418/132 |
| 6,284,332 | B1 * | 9/2001 | Buettner et al. | 428/34.4 |
| 6,325,603 | B1 * | 12/2001 | Moller | 418/86 |
| 6,932,587 | B2 * | 8/2005 | Dong | 418/61.3 |

FOREIGN PATENT DOCUMENTS

| | | |
|---|---|---|
| DE | 67 285 | 5/1969 |
| GB | 926417 | 5/1963 |
| WO | WO 2007/053006 A1 | 5/2007 |

OTHER PUBLICATIONS

Search Report of German Patent Office dated Mar. 5, 2010 (4 pages) and English translation of p. 2.

* cited by examiner

*Primary Examiner* — Thai Ba Trieu
*Assistant Examiner* — Thomas Olszewski
(74) *Attorney, Agent, or Firm* — Flynn, Thiel, Boutell & Tanis, P.C.

(57) ABSTRACT

The invention relates to a rotary piston engine, in particular a rotary engine of trochoidal design, with a side disk (4) on the exhaust side and a rotary piston (6) with at least of one, and preferably three, through-flow openings (6) through which the mixture can flow axially, wherein the side disk (4) on the exhaust side has a side exhaust port (43) and the at least of one through-flow opening (60) has an asymmetric internal contour (600) at least on its exhaust side, so that when the rotary piston (6) passes over the side exhaust port (43) the said side exhaust port (43) is not in fluid communication with an internal area of the through-flow opening (60). The invention further relates to a rotary piston (6) for a rotary piston engine.

9 Claims, 3 Drawing Sheets

ROTARY PISTON FOR A ROTARY PISTON ENGINE AND ROTARY PISTON ENGINE

FIELD OF THE INVENTION

The invention relates to a rotary piston for a rotary piston engine and a rotary piston engine.

BACKGROUND OF THE INVENTION

Rotary pistons, also known simply as rotor, are subject to high thermal loads during the operation of a rotary piston engine. Various methods are known in the prior art for cooling of the rotary piston.

For example, it is known to cool the rotary piston with oil. In addition it can also be cooled using air alone. For less expensive designs it is further known to cool the rotary piston with an air-fuel mixture taken in. Such rotary pistons are termed in the context of the invention as mixture cooled rotary pistons or mixture cooled rotors. With mixture cooled rotary pistons, the mixture flows axially through the engine and provides the necessary heat dissipation at the inner surfaces of the rotary piston. The flow through the engine is intensified by the negative pressure in an intake chamber of the engine.

In known rotary piston engines with mixture cooled rotary pistons, a side inlet and/or circumferential inlet is provided through which the mixture flows into the chamber of the engine. Further, with mixture cooled rotary pistons a circumferential exhaust is provided through which exhaust gas flows. However, a mixture that is not combusted and which remains in the chamber also enters the exhaust to a degree.

SUMMARY OF THE INVENTION

One object of the present invention is to provide an inexpensive rotary piston engine with a mixture cooled rotary piston with improved emission values. A further object of the invention is to provide a rotary piston for a mixture cooled rotary piston engine.

This object is achieved by a rotary piston for a mixture cooled rotary piston engine, in particular for a rotary engine of trochoidal design, with at least one and preferably three through-flow openings through which the mixture can flow axially, wherein the at least of one through-flow opening has an asymmetric internal contour at least on its exhaust side, so that when the rotary piston passes over a side exhaust port of the rotary piston engine the side exhaust port is not in fluid communication with an inner area of the through-flow opening.

The object is further achieved by a rotary piston engine, in particular a rotary engine of trochoidal design, comprising a side disk on the exhaust side and a rotary piston according to the invention with at least one, and preferably three, through-flow openings through which the mixture can flow axially, where the side disk on the exhaust side has a side exhaust port and the at least one through-flow opening has an asymmetric internal contour at least on its exhaust side, so that when the rotary piston passes the side exhaust port, the side exhaust port is not in fluid communication with an inner area of the through-flow opening.

In other words, the apertures of the through-flow openings on the exhaust side and the side exhaust port on the side disk on the exhaust side are matched to each another in such a way that during operation of the engine the aperture on the exhaust side does not coincide with the region of the exhaust port in any position of the rotary piston.

Rotary engines that have a rotary piston housing with 2-arc inner contour (trochoid) and triangular rotary pistons are referred to as rotary engines of trochoidal design.

A fuel-air mixture, referred to simply as the mixture, supplied from a carburetor or injection system, is introduced into an intake chamber of an engine via a side inlet or circumferential inlet. The mixture is, for example, taken in via an intake channel and a recess in the side disk, flows for heat dissipation axially through the rotary piston from the recess in the side disk via one of the through-flow openings and is routed to the intake chamber, preferably via a corresponding recess in the side facing the exhaust.

Following the usual 4-stroke process an exhaust gas is discharged, with a side exhaust provided for this purpose in accordance with the invention. With a side exhaust, an uncombusted residual gas remains in the chamber and is admixed with newly-introduced mixture in the next cycle. This improves the efficiency of the engine and its emission values. The side exhaust is unblocked or blocked by the rotary piston, depending on its position in the direction of an exhaust chamber or expansion chamber. The asymmetric arrangement of the internal contour of the through-flow openings at least on the exhaust side of the rotary piston enables large through-flow openings to be provided for good cooling and where necessary good feed of the mixture to the intake chamber, whilst at the same time enabling a mixture cooled inner chamber of the rotary piston to be kept separate from the side exhaust port at all times.

Sealing strips are arranged preferably on an outer contour of the rotary piston. The sealing strips may be formed in a conventional way, with the sealing strips also sealing the expansion chamber and/or the exhaust chamber in the direction of the exhaust port. When passing over the exhaust port with a leading outer contour, the exhaust port is opened in the direction of the expansion chamber. When passing over the exhaust port with a trailing outer contour, the exhaust port is closed in the direction of the exhaust chamber.

In one embodiment of the invention the at least one through-flow opening has, on one exhaust side of the rotary piston, a thrust surface which during operation lies against a side disk of the rotary piston engine on the exhaust side. The exhaust side of the rotary piston in the context of the invention is the surface of the rotary piston which faces the side disk on the exhaust side. The axial action of the gas pressure forces the thrust surface in the direction of the side disk during operation, where a lasting contact position can be achieved. The thrust surfaces are formed as an insert in one embodiment which can be inserted into the through-flow openings. In other embodiments, the thrust surfaces are disposed on a side surface of the rotary piston on the exhaust side, where the thrust surfaces in part cover the through-flow openings so that an asymmetric internal contour of the through-flow openings on the exhaust side is created. In other embodiments, the thrust surfaces are formed as one part with the rotary piston. In one embodiment, the thrust surfaces are manufactured from a suitable material and/or coated with such a material to insure contact with the side disk that is free of wear.

Preferably, the side rotor surfaces of the rotary piston subject to gas pressure during operation are larger on the side opposite to the exhaust than on the exhaust side. As a result, the rotary piston is forced by the gas pressure in the direction of the exhaust side, resulting in an improvement in the pressing of the rotary piston, especially of the thrust surfaces, against the side disk on the exhaust side.

The side exhaust port is preferably sealable by the rotary piston at the time of, or before, the smallest volume is reached in an exhaust chamber, in other words, within or before the overlap TDC. Further, the rotary piston is preferably designed such that the side exhaust port can be opened by the rotary piston over a range of approximately 20° to approximately 30° before the maximum volume is reached in the exhaust chamber for exhaust gas discharge.

In a further advantageous embodiment, a heat-insulating insert is provided in an exhaust channel of the side disk on the exhaust side. This reduces the heat load on the side disk during operation.

BRIEF DESCRIPTION OF THE DRAWINGS

Further advantages of the invention are derived from the sub-objects and from the following description of an embodiment of the invention, shown schematically in the drawings. Uniform numbering is used in the diagrams for parts that are the same or similar.

The drawings show schematically.

DETAILED DESCRIPTION

Figure 1:
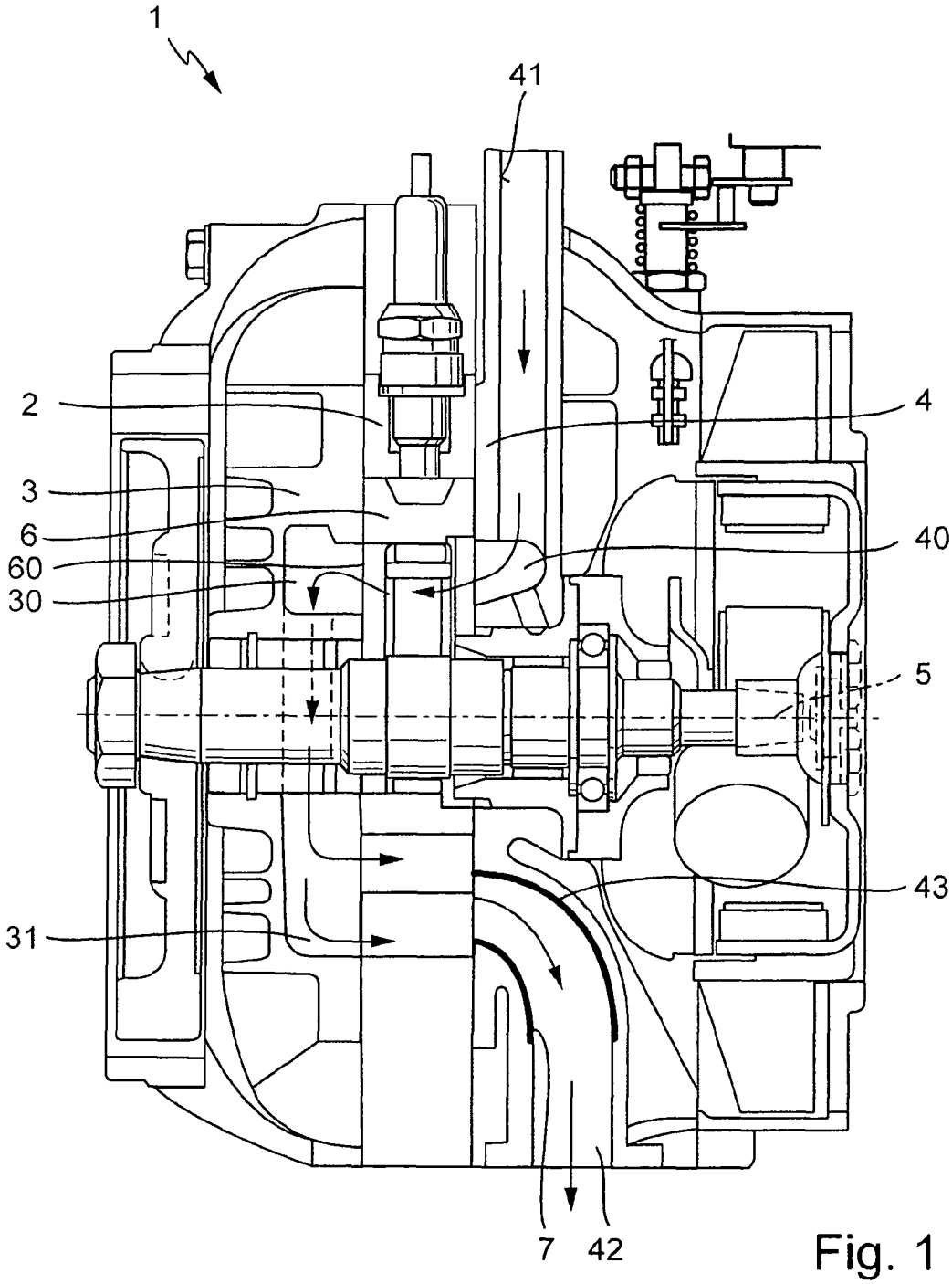
FIG. 1: A sectional view of a rotary engine according to the invention with one rotary piston

FIG. 1 is a schematic sectional view of a rotary engine 1. The rotary engine 1 comprises a central housing 2, side disks 3, 4, an eccentric shaft 5 and a rotary piston 6 mounted on the eccentric shaft 5.

The arrows show the flow of cooling medium through the rotary engine 1 in schematic form. The mixture is used as the cooling medium. The mixture is taken in from an intake channel 41 through a recess 40 on the side disk 4 shown on the right in FIG. 1 and passes axially through the rotary piston 6 via a through-flow opening 60 provided in the rotary piston 6. The mixture passes in this way to a recess 30 in the side disk 30 shown on the left in FIG. 1 and flows through a side intake port 31 into an intake chamber.

Following a generally-known 4-stroke process, the combusted mixture is discharged via an exhaust channel 42 in the side disk 4. The side disk 4 is therefore also designated as a side disk on the exhaust side. The opposing side disk 3 is also designated as the side disk on the side opposite to the exhaust side. To reduce the effect of temperature loads on the side disk 4 on the exhaust side, the embodiment shown has an insulating insert 7 in the exhaust channel 42. The mixture is supplied according to the invention to the exhaust channel 42 via a side exhaust 43. Such an arrangement of the exhaust 43 has the advantage that during the 4-stroke process uncombusted mixture remains in the chamber. The design of a rotary engine 1 with a side exhaust 43 is made possible by the special design of the rotary piston 6.

Figure 2:
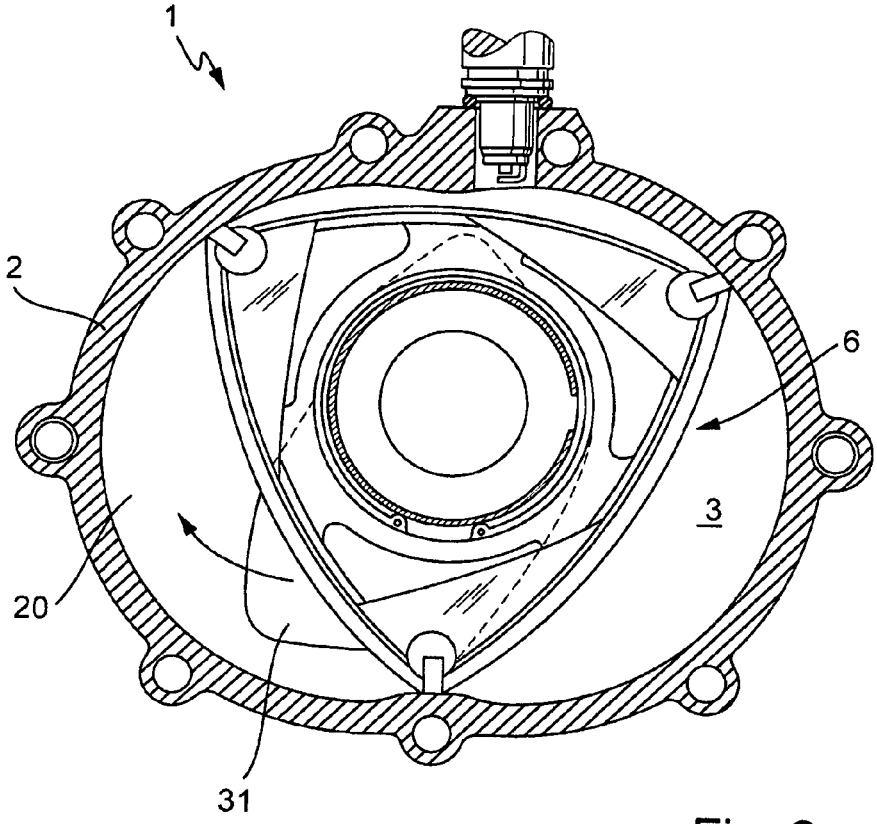
FIG. 2: An axial view through the rotary engine according to FIG. 1 of a side disk on the side facing the exhaust side

FIG. 2 is an axial view through the rotary engine 1 of the side disk 3 during inflow of the mixture via the side intake port 31, as shown schematically by an arrow. The mixture is thereby taken in into the intake or inlet chamber 20, with the flow through the rotary piston 6 being accelerated by a negative pressure in the intake chamber 20.

Figure 3:
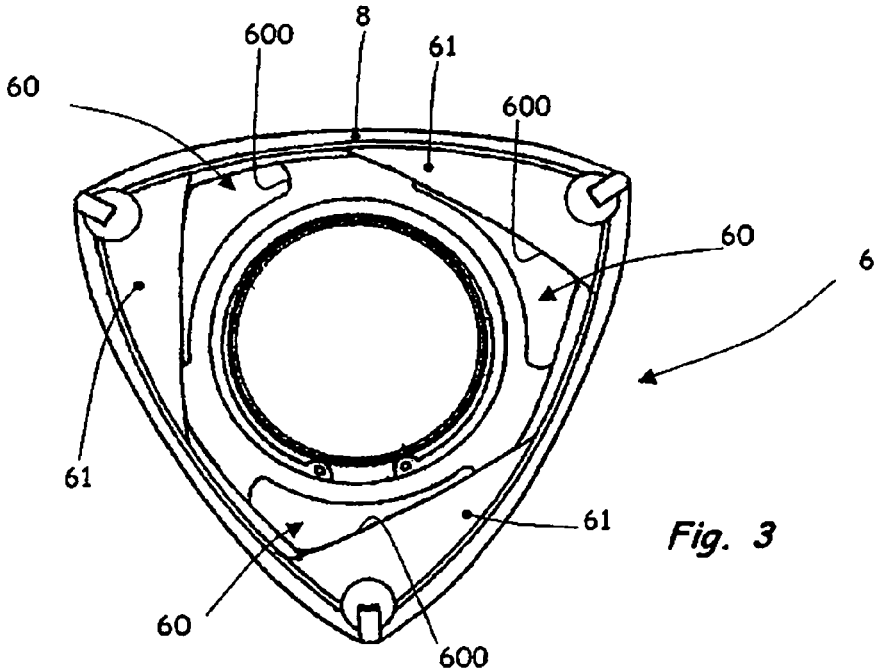
FIG. 3: A top view of a rotary piston according to the invention

FIG. 3 shows a rotary piston 6 according to the invention schematically with three through-flow openings 60 through which a mixture can flow axially in a top view of the side of the rotary piston facing the side disk 4 on the exhaust side. The through-flow openings 60 have an asymmetric internal contour 600 on the exhaust side visible in FIG. 3. As a result of the asymmetric internal contour 600, when the rotary piston 6 passes over the side exhaust port 43 in accordance with FIG. 1, the side exhaust port 43, and thus the exhaust channel 42, are not in fluid communication with an inner area of the rotary piston 6, i.e., an inner area of the through-flow openings 60. In other words, as a result of the asymmetric internal contour 600, the side exhaust port 43 is always kept separate from the through-flow openings 60.

In the embodiment shown, the rotary piston 6 has thrust surfaces 61 on the exhaust side shown in FIG. 3, with the thrust surfaces 61 partially covering the through-flow openings 60 so that an internal contour of the aperture of the through-flow openings 60 is reduced on the exhaust side. Sealing strips 8 are arranged on the side edges of the rotary piston. To force the thrust surfaces 61 against the side disk 4 on the exhaust side in accordance with FIG. 1, the side rotary piston surfaces of the rotary piston 6 are preferably of larger dimensions than those on the exhaust side so that the rotary piston 6 is forced in the direction of the side disk 4 on the exhaust side by the axial gas pressure action. This yields a continuous contact position of the thrust surfaces 61 on a surface of the side disk 4 on the exhaust side.

Figure 4:
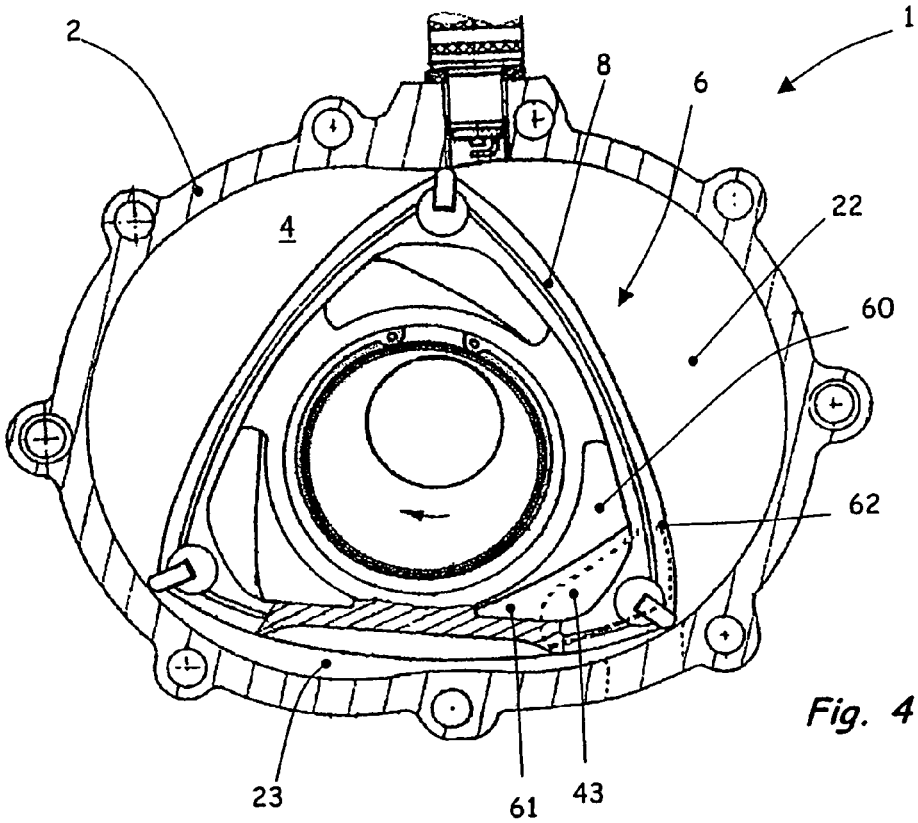
FIG. 4: An axial view through the rotary engine according to FIG. 1 of a side disk on the exhaust side upon opening of a side exhaust port.
Figure 5:
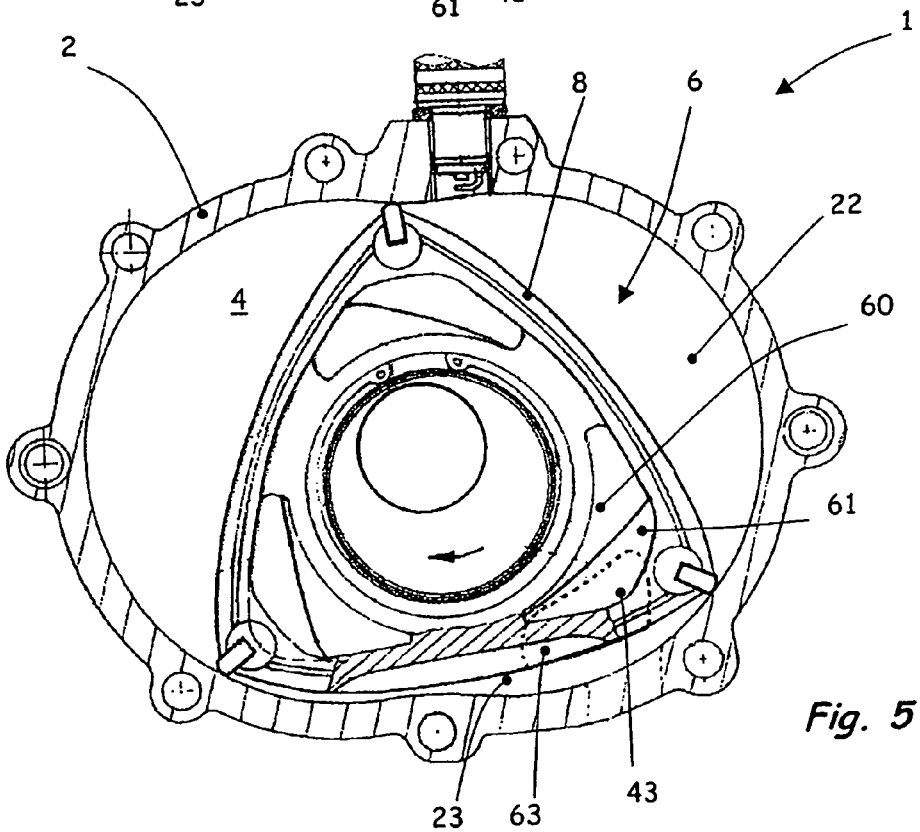
FIG. 5: A view according to FIG. 4 of the side disk on the exhaust side upon closing of the side exhaust port.

FIGS. 4 and 5 show axial views in schematic form through the rotary engine 1 in accordance with FIG. 1 of the side disk 4 on the exhaust side upon opening (FIG. 4) of the side exhaust port 43 and upon closing (FIG. 5) of the side exhaust port 43. In the position of the rotary piston 6 shown in FIG. 4, the exhaust port 43 is sealed off from the chambers 22, 23 of the rotary engine 1 by the sealing strips 8. The thrust surface 61 seals the exhaust port 43 off from the through-flow openings 60 and thus the inner area of the rotary piston 6. The rotary piston 6 continues its rotation in the direction shown by the arrow, where the rotary piston 6 is moved with its leading outer contour 62 over the exhaust port 43 so that the exhaust port 43 opens in the direction of the chamber 22. The exhaust port 43, however, remains separated from the inner area of the rotary piston 6 because of the asymmetric contour of the aperture of the through-flow opening 60. This prevents an exhaust gas from the chamber 22 from entering the inner area of the rotary piston 6. An opening of the exhaust port 43 for an exhaust gas preferably occurs at the latest over a range of 20° to 30° eccentric shaft angle before the maximum volume is attained in the chamber 22.

FIG. 5 shows a view similar to that in FIG. 4 upon closing of the exhaust port 43. The closing is carried out in that the trailing outer contour 63 is displaced over the region of the exhaust port 43 and the rotary piston 6 is sealed off from the chamber 23 by the sealing strip 8 of the exhaust port 43. In this position too, the exhaust port 43 remains separated from the through-flow opening 60. In a further movement, the exhaust port 43 is opened towards the chamber 22 according to FIG. 2 so that combusted and expanded exhaust gas can be discharged via the exhaust port 43.

The internal contour 600 of the through-flow openings 60 shown is naturally only an example. The internal contour 600 and the contour of the exhaust port 43 are, however, always matched to one another in such a way that the exhaust port 43 is always separated from the through-flow openings 60.

The invention claimed is:

1. A rotary piston engine of trochoidal design, comprising a side disk on an exhaust side and a rotary piston with three through-flow openings through which a mixture can flow axially, wherein the side disk on the exhaust side has a side exhaust port and the through-flow openings each have an asymmetric internal contour at least on the exhaust side so that when the rotary piston passes over the side exhaust port the side exhaust port is not in fluid communication with an internal area of the through-flow openings.

2. A rotary piston for a mixture cooled rotary piston engine of trochoidal design, with at least one through-flow opening through which a mixture can flow axially; wherein the at least one through-flow opening has an asymmetric internal contour at least on an exhaust side so that when the rotary piston passes over a side exhaust port of the rotary piston engine the side exhaust port is not in fluid communication with an internal area of the at least one through-flow opening; and wherein side faces of the rotary piston subject to gas pressure have larger dimensions on a side opposite the exhaust side than those on the exhaust side.

3. The rotary piston according to claim 2, wherein, on the exhaust side of the rotary piston, the at least one through-flow opening has a thrust surface which during operation lies against a side disk of the rotary piston engine on the exhaust side.

4. A rotary piston engine of trochoidal design, comprising a side disk on an exhaust side and a rotary piston with three through-flow openings through which a mixture can flow axially, wherein the side disk on the exhaust side has a side exhaust port and the through-flow openings each have an asymmetric internal contour at least on the exhaust side of the rotary piston, and wherein the asymmetric internal contour on the exhaust side of each of the through-flow openings is matched to an aperture on the side exhaust port, so that when the rotary piston passes over the side exhaust port the side exhaust port is not in fluid communication with an internal area of the through-flow openings.

5. The rotary piston engine according to claim 4, wherein the side exhaust port is configured to be closed by the rotary piston, or before a minimum volume is reached in an exhaust chamber.

6. The rotary piston engine according to claim 4, wherein the side exhaust port is configured to be opened through approximately 20° to approximately 30° by the rotary piston before attainment of a maximum volume in an exhaust chamber for discharge of exhaust gas.

7. The rotary piston engine according to claim 4, wherein, on the exhaust side of the rotary piston, the three through-flow openings each have a thrust surface which during operation lies against the side disk of the rotary piston engine on the exhaust side.

8. The rotary piston engine according to claim 4, wherein, side rotor surfaces of the rotary piston subject to gas pressure are of larger dimensions on a side opposite to the exhaust side than those on the exhaust side.

9. The rotary piston engine according to claim 4, wherein a heat-insulating insert is provided in an exhaust channel of the side disk on the exhaust side.

* * * * *